US007398660B2

(12) United States Patent
Shalev et al.

(10) Patent No.: US 7,398,660 B2
(45) Date of Patent: Jul. 15, 2008

(54) DYEING APPARATUS AND METHOD THEREFOR

(75) Inventors: Itzhak Shalev, Bet Gamliel (IL); Kirk E. Faulkner, Louisburg, NC (US)

(73) Assignee: Zzakey Technologies Ltd, Bet Gamliel (IL)

( * ) Notice: Subject to any disclaimer, the term of this patent is extended or adjusted under 35 U.S.C. 154(b) by 0 days.

(21) Appl. No.: 11/225,161

(22) Filed: Sep. 14, 2005

(65) Prior Publication Data

US 2007/0056122 A1 Mar. 15, 2007

(51) Int. Cl.

| | |
|---|---|
| ***B08B 3/12*** | (2006.01) |
| ***D06F 37/00*** | (2006.01) |
| ***D06F 31/00*** | (2006.01) |
| ***D06F 33/00*** | (2006.01) |
| ***D06F 5/00*** | (2006.01) |

(52) U.S. Cl. ..... 68/5 D; 68/11; 68/12.07; 8/504; 8/932; 8/934

(58) Field of Classification Search ..... 68/5 D, 68/5 R, 11, 12.07; 8/504, 932, 934
See application file for complete search history.

(56) References Cited

U.S. PATENT DOCUMENTS

| | | | | | |
|---|---|---|---|---|---|
| 2,693,995 | A | * | 11/1954 | Hannay et al. | 8/500 |
| 3,289,439 | A | * | 12/1966 | Hall | 68/15 |
| 3,871,819 | A | * | 3/1975 | Greer | 8/130.1 |
| 3,958,934 | A | | 5/1976 | Jackson | |
| 3,995,457 | A | * | 12/1976 | Kinomoto et al. | 68/13 R |
| 4,046,506 | A | | 9/1977 | Feess | |
| 4,082,504 | A | * | 4/1978 | Von Der Eltz | 8/499 |
| 4,136,535 | A | * | 1/1979 | Audas | 68/5 E |
| 4,607,409 | A | * | 8/1986 | Hishimuma et al. | 8/152 |
| 4,878,365 | A | | 11/1989 | Kutz | |
| 4,997,453 | A | | 3/1991 | Kutz | |
| 5,050,258 | A | | 9/1991 | Fischer et al. | |

(Continued)

OTHER PUBLICATIONS http://www.e4s.org.uk/textilesonline/content/pdfs/report3.pdf
BTTG Textile Processing Techniques of textile industry. see p. 19.

(Continued)

*Primary Examiner*—Michael Barr
*Assistant Examiner*—Rita R Patel
(74) *Attorney, Agent, or Firm*—Mark M. Friedman Ltd.

(57) ABSTRACT

A dyeing apparatus and method for continuous dyeing of a fabric article with dye, the apparatus including: (a) a dyeing vessel for containing a high-density liquid; (b) a heating mechanism, thermally associated with the dyeing vessel, for heating a dye fixation zone within the vessel to a temperature above 70° C.; (c) a continuous transport mechanism for continuously transporting the fabric article, through a dye impregnation chamber, and through the dye fixation zone of the dyeing vessel, and (d) a dye-dispensing mechanism for delivering a dye liquor within the dye impregnation chamber, so as to impregnate with the dye, the fabric article passing through the chamber, and wherein the dyeing vessel is dimensioned and configured such that a height of the high-density liquid delivers a hydrostatic pressure of at least 0.1 bar gauge to the dye fixation zone, so as to effect fixation of the dye in the fabric article.

20 Claims, 2 Drawing Sheets

U.S. PATENT DOCUMENTS

| | | | | |
|---|---|---|---|---|
| 5,205,008 | A | 4/1993 | Kohnen | |
| 5,351,754 | A * | 10/1994 | Hardin et al. | 166/249 |
| 6,364,189 | B1 | 4/2002 | Fischer | |

OTHER PUBLICATIONS http://www.textileworld.com/News.htm?CD=269&ID=1226 periodical article describing advances in textile dyeing refering to new applications in continuous dyeing processes.

http://www.textileworld.com/News.htm?CD=2301&ID=6719 another review. see "continuous dyeing". very little news.

http://www.textileworld.com/News.htm?CD=24&ID=844 article describing difficulties in conventional continuous dyeing of polyester.

http://www.epa.gov/ttn/atw/coat/fabric/pic-fabr.pdf Preliminary Industry Characterization : Fabric Printing , Coating , and Dyeing—EPA review of the textile industy see pp. 11-40.

http://www.epa.gov/ttn/atw/fabric/fabrictsdp.pdf p. 2-3 Technical Support Document : Printing coating and Dyeing of Fabrics and other textiles proposed NESHAP.

* cited by examiner

DYEING APPARATUS AND METHOD THEREFOR

FIELD AND BACKGROUND OF THE INVENTION

The present invention relates to a continuous fabric-dyeing apparatus and a method therefor, and, more particularly, to a continuous fabric-dyeing apparatus for, and method of, dyeing bulky, three-dimensional fabrics and narrow fabrics having a plurality of hard protrusions such as a trim tape, zip tape, hook-and-loop fastener tape, and braided cords.

Various known machines for continuous dyeing of narrow fabrics rely on a dip trough and roller squeezing mechanism, commonly referred to as a padding machine, to control the amount of dye liquor deposited on the fabric (U.S. Pat. Nos. 5,050,258, 5,205,008, 4,878,365, and 3,995,457). The padding machine may include single or multiple baths (U.S. Pat. No. 4,997,453). Alternatives to squeeze rollers such as absorbent fiber webs, have been taught (U.S. Pat. No. 4,046,506). The impregnated fabric is then subjected to dry or steam heating to fix the dye in the fibers of the fabric (U.S. Pat. No. 6,364,189). Alternative heating media have been taught such as high boiling-point fluorocarbon liquids (U.S. Pat. No. 3,958,934). The fabric is then washed off to remove excess unfixed dyestuff. Various continuous dyeing methods of impregnating-dipping, squeezing and thermally fixing are also known.

When the fabric for dyeing is a three-dimensional fabric, a narrow fabric having a plurality of hard protrusions, and the like, the above-referenced machines for continuous dyeing are prone to producing an unevenly dyed product, due to uneven pressure from the squeeze rollers. Additionally, such machines may be subject to frequent deformation of the squeezing rollers, guides and feed rollers because the protrusions on the fabric continuously gouge these elements as the fabric traverses the machine.

There is therefore a recognized need for, and it would be highly advantageous to have, a continuous fabric-dyeing apparatus for, and method of, dyeing bulky, three-dimensional fabrics and narrow fabrics having a plurality of hard protrusions, that produce an evenly dyed product. It would be of further advantage if the apparatus and method would be simple, robust, and economical, with respect to the known art.

SUMMARY OF THE INVENTION

The present invention is a continuous dyeing apparatus and method therefor.

According to the teachings of the present invention there is provided a dyeing apparatus for continuous dyeing of a fabric article with dye, the apparatus including: (a) a dyeing vessel for containing therein a high-density liquid; (b) a heating mechanism, thermally associated with the dyeing vessel, for heating a dye fixation zone within the vessel to a temperature above 70° C.; (c) a continuous transport mechanism for continuously transporting the fabric article, through a dye impregnation chamber, and through the dye fixation zone of the dyeing vessel, and (d) a dye-dispensing mechanism for delivering a dye liquor within the dye impregnation chamber, so as to impregnate with the dye, the fabric article passing through the chamber, wherein the dyeing vessel is dimensioned and configured such that a height of the high-density liquid, when disposed in the vessel, delivers a hydrostatic pressure of at least 0.1 bar gauge to the dye fixation zone, so as to effect fixation of the dye in the fabric article.

According to further features in the described preferred embodiments, the dyeing vessel includes at least a first upwardly directed member and a second upwardly directed member for containing therein the high-density liquid, the first upwardly directed member for allowing the transporting of the fabric article downwards into the dye fixation zone, and the second upwardly directed member for allowing the transporting of the fabric article upwards out of the dye fixation zone.

According to still further features in the described preferred embodiments, the dyeing vessel is further configured so as to fluidly communicate with an ambient environment.

According to still further features in the described preferred embodiments, the first upwardly directed member and second upwardly directed member are associated so as to form a first U-tube.

According to still further features in the described preferred embodiments, the U-tube is further configured so as to fluidly communicate with an ambient environment.

According to still further features in the described preferred embodiments, the dyeing vessel includes the first U-tube and at least a second U-tube, the first and second U-tubes connected in series, the second U-tube having upwardly directed members.

According to still further features in the described preferred embodiments, the first and second U-tubes connected in the series are fluidly connected by an inverted U-tube disposed therebetween.

According to still further features in the described preferred embodiments, the dyeing vessel at least partially contains the dye impregnation chamber, such that the dye liquor for the dye impregnation chamber is disposed above the high-density liquid when disposed in the dyeing vessel.

According to still further features in the described preferred embodiments, the transport mechanism includes at least one guide disposed within the dyeing vessel, the guide being configured for guiding the fabric article within the dyeing vessel.

According to still further features in the described preferred embodiments, the guide is a rotating guide, the rotating guide being configured for guiding the fabric article within the dye fixation zone within the dyeing vessel.

According to still further features in the described preferred embodiments, the transport mechanism includes at least one rotating guide being configured for guiding the fabric article around a curve in a bottom section of the first U-tube.

According to still further features in the described preferred embodiments, the dye-dispensing mechanism includes a reservoir.

According to still further features in the described preferred embodiments, the dyeing apparatus further includes: (e) at least one air jet, disposed with respect to the dyeing vessel so as to deliver an air stream on the fabric article after the article has been conveyed out of the dye fixation zone by the continuous transport mechanism.

According to still further features in the described preferred embodiments, the dyeing apparatus further includes: (e) at least one brushing mechanism including a brush, disposed with respect to the dyeing vessel such that the brush impinges on the fabric article after the article has been conveyed out of the dye fixation zone by the continuous transport mechanism.

According to still further features in the described preferred embodiments, the apparatus further includes the high-density liquid.

According to still further features in the described preferred embodiments, the high-density liquid includes at least one molten metal.

According to another aspect of the present invention there is provided a continuous method of dyeing a fabric article with dye, the method including the steps of: (a) providing a dyeing apparatus including: (i) a dyeing vessel for containing therein a high-density liquid; (ii) a heating mechanism, thermally associated with the dyeing vessel, and (iii) a continuous transport mechanism for continuously transporting the fabric article, through a dye impregnation chamber, and through a dye fixation zone of the dyeing vessel; (b) impregnating the fabric article with the dye in the dye impregnation chamber; (c) maintaining, within the dye fixation zone, a hydrostatic pressure of at least 0.1 bar gauge using the high-density liquid, and a temperature of at least 70° C., using the heating mechanism, and (d) passing the fabric article through the high-density liquid and into the dye fixation zone so as to fixate the dye on the fabric article.

According to still further features in the described preferred embodiments, the high-density liquid has a specific gravity above 6.

According to still further features in the described preferred embodiments, the high-density liquid includes at least one liquid selected from the group consisting of high molecular-weight polymer liquids and salt brines.

According to still further features in the described preferred embodiments, the high-density liquid includes at least one molten metal.

According to still further features in the described preferred embodiments, the fabric article is a tape.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

DESCRIPTION OF THE PREFERRED EMBODIMENTS

Figure 1:
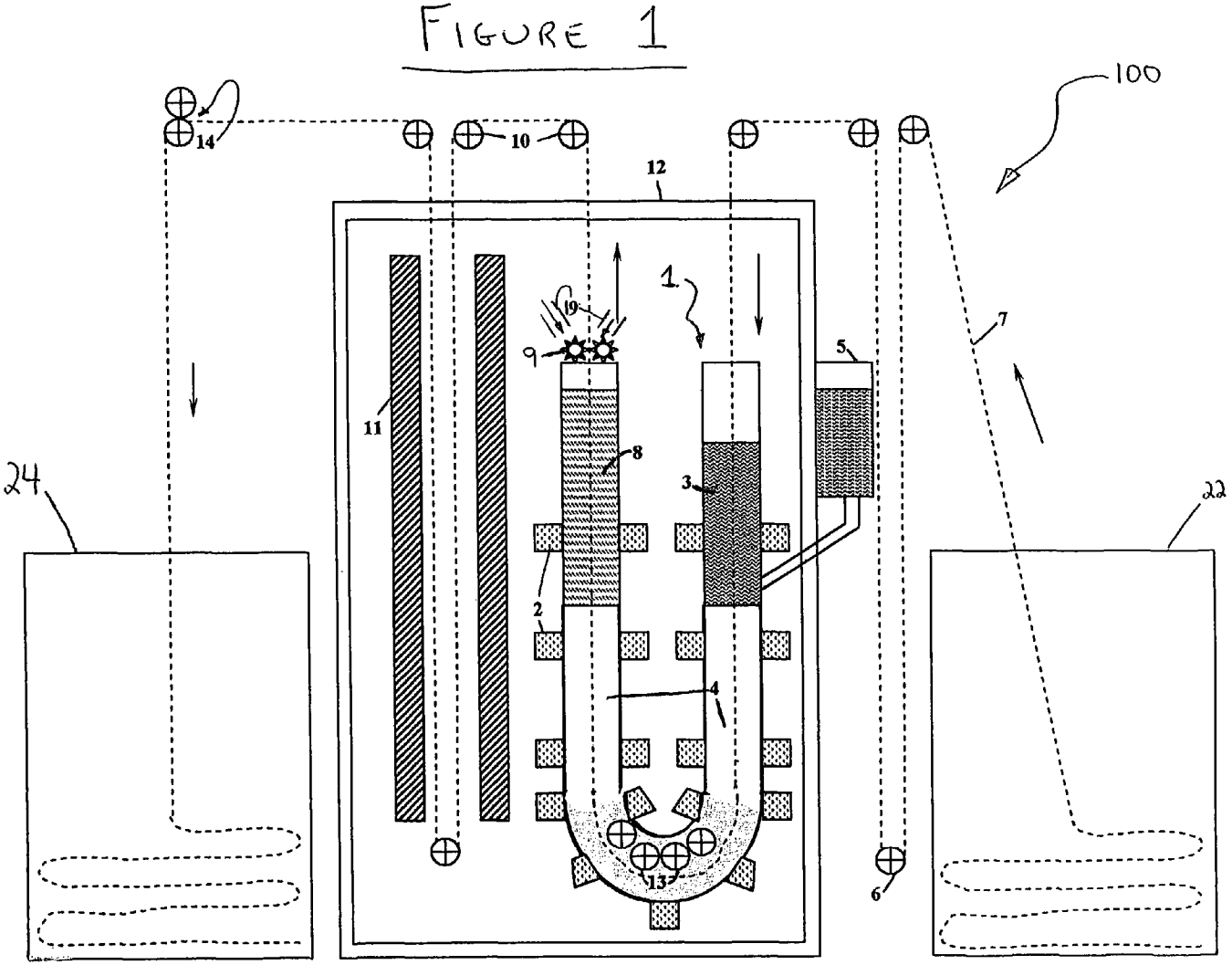
FIG. 1 is a schematic cross-sectional representation of a continuous dyeing apparatus according to a first embodiment of the present invention.

The present invention is a continuous dyeing apparatus and method therefor.

The principles and operation of the continuous dyeing apparatus and method according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

An object of the present invention is to provide a continuous dyeing apparatus for controllably dyeing articles such as bulky and uneven narrow fabric without entailing problems such as uneven dyeing of fabric and deformation of the dyeing machine squeezing rollers and guide rollers.

To accomplish this object, the present invention provides a dyeing apparatus having a dyeing vessel adapted to contain a high-density liquid heating medium therein. The dyeing apparatus has a transport mechanism and rollers for transporting the fabric article through the dyeing vessel. The penetration of the dye substance into the fabric article is effected by subjecting the article to superambient pressure and superambient temperature as the article is continuously conveyed through the dyeing vessel.

A schematic cross-sectional representation of a continuous dyeing apparatus 100 according to a first embodiment of the present invention is provided in FIG. 1. Dyeing apparatus 100 preferably includes a dyeing vessel 1, electrical coil heating members 2, a dye reservoir 5, a let-off device 6, a tape or fabric 7 to be dyed, an air jet device 19 and/or a brushing device 9, guide rollers 10, a drying device 11, a frame 12, and a motorized transport device 14.

As will be elaborated hereinbelow, dyeing vessel 1 includes a dye liquor impregnation zone 3, a zone containing a high-density liquid heating medium 4, and a wash-off zone 8.

In the embodiment schematically provided in FIG. 1, dyeing vessel 1 is a vertically oriented, cylindrical "U"-shaped tube. Typically, dyeing vessel 1 has a height of 150 centimeters and a diameter of 10 centimeters, and contains a dense liquid for providing heat at 135° C. The liquid may contain bismuth, tin, lead, indium or cadmium, or a combination thereof (e.g., Neylo® 158, obtained from Ney Metals®, N.Y., N.Y.). The tape to be dyed is continuously fed from a package, box or reel 22 into dye liquor impregnation zone 3. Preferably, dye liquor impregnation zone 3, is situated within the tube of dyeing vessel 1, above high-density liquid heating medium 4. Alternatively, dye liquor impregnation zone 3 may be disposed outside of the U-tube.

Fresh dye liquor stored within dye reservoir 5 is continuously or intermittently fed to the impregnation zone 3 so as to maintain a substantially constant amount of dye therein.

When motorized transport device 14 is operated, tape 7, which is engaged by transport device 14, is conveyed through the tube of dyeing vessel 1. After being impregnated with dyestuff in impregnation zone 3, tape 7 passes through high-density liquid heating medium 4. As tape 7 proceeds downwards, the hydrostatic pressure in the tube of dyeing vessel 1 gradually increases. Electrical coil heating members 2, disposed around the tube of dyeing vessel 1, supply heat so as to attain the requisite temperature. Depending on the particular application, the requisite temperature is at least 60° C., and more typically 130° C., and up to at least 200° C.

Similarly, for a given high-density liquid, the height of the liquid determines the hydrostatic pressure in the tube. Thus, the height of the liquid can be adjusted to attain the requisite pressure for a given application. Preferably, the requisite pressure is above 0.1 bar, more preferably, above 1 bar, and most preferably, from 1 bar to 6 bar.

As used herein in the specification and in the claims section that follows, the term for the units of pressure, "bar" values are gauge values.

The bottom of the tube of dyeing vessel 1 is preferably curved, so as to facilitate the movement of tape 7 therethrough. The movement of tape 7 is further facilitated by tape guides disposed within the tube. In an exemplary embodiment provided in FIG. 1, the tape guides (rotating guides or bearings 13) are disposed within the U-tube of dyeing vessel 1, near the inner curve of the U-tube, such that tape 7 passes between rotating guides 13 and the outer curve of the U-tube. Rotating guides 13 serve, inter alia, to guide tape 7 while reducing frictional forces and preventing tearing of tape 7 and/or damage to the dyeing process.

After passing around rotating guides 13, tape 7 proceeds upwards through high-density liquid heating medium 4, and subsequently, through wash-off zone 8. After emerging from the tube, tape 7 passes through air jet device 19 and brushing device 9, where the cleaning operation is completed. Subsequently, tape 7 is dried as it passes through a drying device 11, before tape 7 is collected in/on a package, box or reel 24.

Dyeing vessel 1 is advantageously disposed in a housing 12, which may also include drying device 11. Although housing 12 may also contain dye reservoir 5, it is usually preferable to situate dye reservoir 5 outside of housing 12, so as to facilitate the introduction of additional dye material to reservoir 5.

It will be apparent to one skilled in the art that various mechanical elements, such as a let-off element 6, and guide rollers 10, may be advantageously employed in conveying tape 7 through continuous dyeing apparatus 100.

Although high-density liquid heating medium 4 preferably includes molten metals, as described hereinabove, other high-density liquids may be suitable, provided that the liquids engender and maintain the requisite pressure range (and 0.1 bar to 6 bar) and temperature range (60° C. to 200° C.) for a particular dyeing application. Thus, in another preferred embodiment of the present invention, liquid heating medium 4 includes at least one high-density salt brine (e.g., zinc bromide, calcium bromide, or potassium formate). In this case, the lower specific gravity of the salt brine, with respect to the specific gravity of a molten metal, necessitates a higher fluid level to achieve an identical pressure.

Figure 2:
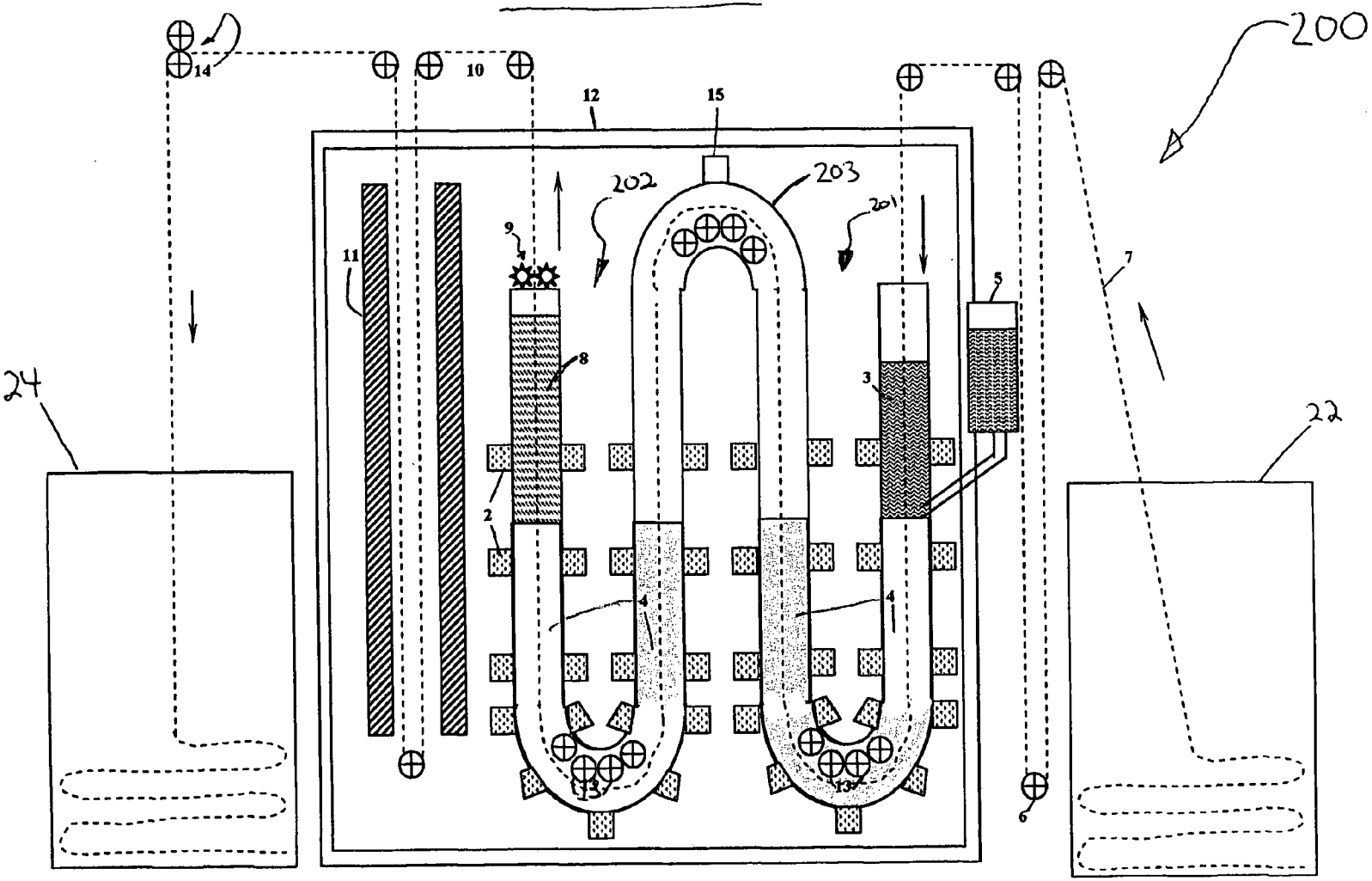
FIG. 2 is a schematic cross-sectional representation of a continuous dyeing apparatus according to a second embodiment of the present invention.

A schematic cross-sectional representation of a continuous dyeing apparatus 200 according to a second embodiment of the present invention is provided in FIG. 2. Dyeing apparatus 200 is largely similar to dyeing apparatus 100 of FIG. 1, but the dyeing vessel includes two vertically oriented, cylindrical, U-shaped tubes 201, 202 and an inverted U-shaped cylindrical tube 203 connecting therebetween. Inverted U-tube 203 normally becomes at least partially filled with water vapor during the course of operation. Hence, inverted U-tube 203 is advantageously equipped with a controlled pressure release valve 15, for stabilizing the pressure within the system.

Fabric or tape 7 to be dyed is continuously fed from a package, box or reel 22 into the dyeing vessel, and is subsequently removed from the dyeing vessel, in a substantially identical method to that described with respect to FIG. 1.

By controlling the speed of traverse, the temperature and height of the liquid heating medium and the concentration and amount of dyestuff in the impregnation zone, consistent and even dyeing is achieved.

Owing to the construction described above, it is possible to dye the article in a continuous, controlled fashion. The apparatus is designed and operated such that an even pressure is applied to all parts of the fabric. Consequently, an even distribution of dyestuff is deposited over the entire fabric article. The pressures and temperatures in the apparatus are predetermined so as to efficiently fix the dyestuff to the article.

It must be emphasized that the present dyeing machine requires no squeeze rollers, and relies on the hydrostatic pressure and thermal energy of the high-density liquid heating medium to control the amount of the dyeing liquid for impregnating in the fabric article. Advantageously, excess dyestuff floats to the top of the high-density liquid so that little or no wash-off is required. The hot liquid also facilitates dye fixation and drying of the article after the dyestuff has penetrated the article.

In a preferred method of dyeing polyester tape to dark shades in the above-described apparatus, disperse dyes (such as Terasil®, Ciba®, Switzerland) are mixed in water containing up to 5% by weight of a dispersing agent (such as IFCO-SOL-DA LIQUID®, Molchemie®, India), up to 5% by weight leveling agent (such as ESQUAL T-56 CONC®), Winimex®, Thailand) and up to 5% by weight organic acid. The resulting dye liquor is introduced into the liquor impregnation zone. The liquid heating medium is heated to 130° C., and the greige tape is traversed through the apparatus at 15 to 30 meters per minute.

As used herein in the specification and in the claims section that follows, the term "high-density liquid" refers to a liquid having a specific gravity above 2, preferably, above 4, more preferably, above 6, and most preferably, above 10.

Although the invention has been described in conjunction with specific embodiments thereof, it is evident that many alternatives, modifications and variations will be apparent to those skilled in the art. For example, although the first embodiment illustrated in FIG. 1 employs a U-shaped vessel, any shape that can contain the high-density heating medium liquid, allow transport of the narrow fabrics therethrough, and engender the temperature/pressure regimen described herein, is included. Moreover, while the U-shaped vessel typically has a circular cross-section, other cross-sections such as oblong, triangular, square, rectangular, multilateral or multilobed, could be used in the apparatus and method of the present invention. More generally, the invention is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A dyeing apparatus for continuous dyeing of a fabric article with dye, the apparatus comprising:

(a) a dyeing vessel having a volume including at least a first generally U-shaped region and a second generally U-shaped region, said regions connected by a third generally U-shaped region, inverted with respect to said first and second regions, to allow fluid communication therebetween;

(b) a heating mechanism, surrounding and adjacent to the U-shaped regions of said dyeing vessel, said heating mechanism adapted to heat a zone within said vessel;

(c) a continuous transport mechanism adapted to continuously transport the fabric article, through a dye impregnation chamber, and through said zone of said dyeing vessel, and (d) a dye-dispensing mechanism adapted to deliver a dye liquor within said dye impregnation chamber, to impregnate with the dye, the fabric article passing through said chamber, wherein said dyeing vessel is equipped with a pressure release valve, associated with said inverted U-shaped region, to control a pressure within said inverted U-shaped region.

2. The dyeing apparatus of claim 1, wherein said dyeing vessel and said heating mechanism are adapted to heat said zone to a temperature of up to at least 130° C.

3. The dyeing apparatus of claim 1, wherein said dyeing vessel and said heating mechanism are adapted to heat said zone to a temperature of up to at least 200° C.

4. The dyeing apparatus of claim 1, wherein said pressure release valve is further adapted to discharge vapor disposed within said inverted U-shaped region.

5. The dyeing apparatus of claim 1, wherein said liquid is disposed within said dyeing vessel, and wherein said inverted U-shaped region is at most partially filled with said liquid.

6. The dyeing apparatus of claim 1, wherein said liquid is disposed within said dyeing vessel, and wherein said inverted U-shaped region is at least partially filled with vapor.

7. The dyeing apparatus of claim 6, wherein said vapor has a superambient vapor pressure.

8. The dyeing apparatus of claim 6, wherein said vapor has a superainbient vapor pressure, wherein said pressure release valve is adapted to control said vapor pressure to stabilize a pressure within the apparatus.

9. The dyeing apparatus of claim 6, wherein said vapor is disposed within a vapor zone of said inverted U-shaped region, said vapor zone disposed to fluidly communicate directly with said pressure release valve.

10. The dyeing apparatus of claim 1, wherein said liquid is disposed within said dyeing vessel, and the fabric article is disposed on said continuous transport mechanism.

11. The dyeing apparatus of claim 10, wherein the fabric article has a plurality of protrusions.

12. The dyeing apparatus of claim 1, wherein said liquid is disposed within said dyeing vessel and a dye liquor is disposed thereabove, and wherein said heating mechanism is adapted to heat said zone to a temperature of up to at least 130° C., during operation of said continuous transport mechanism.

13. The dyeing apparatus of claim 1, wherein said pressure release valve is a controlled pressure release valve.

14. A continuous method of dyeing a fabric article with dye, the method comprising the steps of (a) providing a dyeing apparatus including:

(i) a dyeing vessel having a volume including at least a first generally U-shaped region and a second generally U-shaped region, said regions connected by a third generally U-shaped region, inverted with respect to said first and second regions, to allow fluid communication therebetween;

(ii) a heating mechanism, surrounding and adjacent to the U-shaped regions of said dyeing vessel, said heating mechanism adapted to heat a zone within said vessel;

(iii) a continuous transport mechanism adapted to continuously transport the fabric article, through a dye impregnation chamber, and through said zone of said dyeing vessel, and (iv) a dye-dispensing mechanism adapted to deliver a dye liquor within said dye impregnation chamber, to impregnate with the dye, the fabric article passing though said chamber, wherein said dyeing vessel is equipped with a pressure release valve, associated with said inverted U-shaped region, to control a vapor pressure within said inverted U-shaped region;

(b) impregnating the fabric article with the dye in said dye impregnation chamber, and (c) passing the fabric article through a liquid disposed within said zone of said dyeing vessel, so as to fixate the dye on the fabric article.

15. The method of claim 14, wherein said liquid has a specific gravity above 6.

16. The method of claim 14, further comprising the step of:

(d) heating said zone to a temperature of at least about 130° C.

17. The method of claim 15, further comprising the step of:

(d) heating said zone to a temperature of about 130° C.

18. The method of claim 14, further comprising the step of:

(d) discharging vapor disposed within said inverted U-shaped region, to control said vapor pressure within said inverted U-shaped region.

19. The method of claim 18, wherein said vapor pressure is controlled to obtain a pressure of at least I bar gauge within the apparatus.

20. The method of claim 18, wherein the fabric article is selected from the group of fabric articles consisting of trim tape, zip tape, hook-and-loop fastener tape, and braided cords.

* * * * *